US010697268B2

(12) United States Patent
Melhus et al.

(10) Patent No.: US 10,697,268 B2
(45) Date of Patent: Jun. 30, 2020

(54) METHOD AND SYSTEM FOR PLUGGING A SUBTERRANEAN WELL

(71) Applicant: TCO AS, Indre Arna (NO)

(72) Inventors: Geir Arne Melhus, Bryne (NO); Jostein Elbert, Kjopmannskjaer (NO)

(73) Assignee: TCO AS, Indre Arna (NO)

( * ) Notice: Subject to any disclaimer, the term of this patent is extended or adjusted under 35 U.S.C. 154(b) by 0 days.

(21) Appl. No.: 16/338,016

(22) PCT Filed: Sep. 28, 2017

(86) PCT No.: PCT/NO2017/050252

§ 371 (c)(1),
(2) Date: Mar. 29, 2019

(87) PCT Pub. No.: WO2018/063006

PCT Pub. Date: Apr. 5, 2018

(65) Prior Publication Data

US 2019/0292875 A1 Sep. 26, 2019

(30) Foreign Application Priority Data

Sep. 30, 2016 (NO) ..... 20161576

(51) Int. Cl.
*E21B 33/13* (2006.01)
*E21B 43/116* (2006.01)
(Continued)

(52) U.S. Cl.
CPC ..... *E21B 33/13* (2013.01); *E21B 37/08* (2013.01); *E21B 41/00* (2013.01); *E21B 43/11* (2013.01)

(58) Field of Classification Search
CPC .... E21B 43/26; E21B 43/116; E21B 33/1294; E21B 43/025; E21B 43/261; E21B 33/1208; E21B 33/14
See application file for complete search history.

(56) References Cited

U.S. PATENT DOCUMENTS 3,743,021 A 7/1973 McCauley et al.
3,779,263 A 12/1973 Edwards et al.
(Continued)

FOREIGN PATENT DOCUMENTS

WO 2012096580 A1 7/2012
WO 2013133719 A1 9/2013

OTHER PUBLICATIONS

Ortiz, Jonathan et al., "Drillable Perforating System Saves Effort and Rig Time", SPE (XP055443350), Feb. 23, 2005, cols. 3-4, figures 1-8.

(Continued)

*Primary Examiner* — Zakiya W Bates
(74) *Attorney, Agent, or Firm* — Chamberlain Hrdlicka

(57) ABSTRACT

A method for plugging a subterranean well (6), comprising running a perforating tool (1) into the subterranean well and positioning the perforating tool in a well section (L) to be plugged; operating the perforating tool to create a plurality of holes (10) in a part (5) of a casing (4) located in the well section; running a surge tool (2) into the well; operating the surge tool (2) to lower the pressure inside the part (5) of the casing (4) located in the well section (L) and flowing a well fluid from an annulus (11) between the casing (4) and a well formation (7) through the holes (10); and pumping a fluidized plugging material into the well section (L) via a tubing string (9).

13 Claims, 8 Drawing Sheets

(51) Int. Cl.

| | |
|---|---|
| ***E21B 41/00*** | (2006.01) |
| ***E21B 43/11*** | (2006.01) |
| ***E21B 37/08*** | (2006.01) |

(56) References Cited

U.S. PATENT DOCUMENTS

| | | | | |
|---|---|---|---|---|
| 4,538,680 | A | 9/1985 | Brieger et al. | |
| 4,605,074 | A * | 8/1986 | Barfield | E21B 34/063 166/297 |
| 4,658,902 | A | 4/1987 | Wesson et al. | |
| 4,688,640 | A | 8/1987 | Pritchard, Jr. | |
| 6,598,682 | B2 | 7/2003 | Johnson et al. | |
| 2004/0231840 | A1 | 11/2004 | Ratanasirigulchai et al. | |
| 2009/0151952 | A1 | 6/2009 | Walton | |
| 2017/0321525 | A1* | 11/2017 | Saltel | E21B 43/103 |

OTHER PUBLICATIONS

International Search Report and Written Opinion dated Jan. 31, 2018 for PCT Application No. PCT/NO2017/050252 filed Sep. 28, 2017, 10 pages.

* cited by examiner

METHOD AND SYSTEM FOR PLUGGING A SUBTERRANEAN WELL

The present invention relates to a method and system for plugging a subterranean well, for example such wells used in petroleum exploration and exploitation.

BACKGROUND

Wells, such as petroleum wells, must generally be safely plugged when abandoned. This is a critical operation since both health and safety risk and potential environmental damage may result if an abandoned well is not reliably sealed off. Various statutory requirements exist in relation to how such plug and abandonment may be carried out. This is typically done by filling a section of the wellbore with a fluidized plugging material, such as cement, which will harden and create a safe, long-lasting barrier in the well.

In wells having a casing, there may be a need to ensure that the wellbore is sealed both inside and outside of the casing, i.e. also in the annulus between the casing and the formation. One prior art method of achieving this is to remove a section of the casing and to arrange a cement plug in the wellbore. Another method, in which a casing is perforated and a plugging material is placed in the casing and in the annulus is described in WO 2012/096580 A1.

In addition to the above, well operations generally require highly specialized equipment and can thus be very expensive. There is therefore a need for improved solutions which allow plugging operations to be carried out efficiently, while maintaining a high level of safety and the ability to create a reliable plug. The present invention aims to provide an improved method and system, addressing at least one of these objectives, compared to known techniques.

SUMMARY

In an embodiment, there is provided a method for plugging a subterranean well, comprising the steps: running a perforating tool into the subterranean well and positioning the perforating tool in a well section to be plugged; operating the perforating tool to create a plurality of holes in a part of a casing located in the well section; running a surge tool into the well; operating the surge tool to lower the pressure inside the part of the casing located in the well section and flowing a well fluid from an annulus between the casing and a well formation through the holes; and pumping a fluidized plugging material into the well section via a tubing string.

In an embodiment, there is provided a surge tool for use in a subterranean well, having a fluid chamber and a flow barrier element, where the flow barrier element is a valve or the flow barrier element is a breakable fluid restriction, the surge tool being configured to flow fluid from the subterranean well into the fluid chamber upon opening of the fluid barrier element.

The appended dependent claims outline additional embodiments.

DETAILED DESCRIPTION

When carrying out cementing operations for plug and abandonment of wells, it is of high importance that the cement plug is properly set in order to ensure its structural integrity and reliability. When perforating a casing and setting a cement plug through pumping a plugging material into the casing and into the annulus between the casing and the wellbore, it may be necessary to clean the annulus prior to pumping in the plugging material, such as cement. This may be achieved by circulating a cleaning fluid in the annulus region to be plugged, e.g. pumping the cleaning fluid out through the perforations in the casing and into the annulus.

Figure 1:
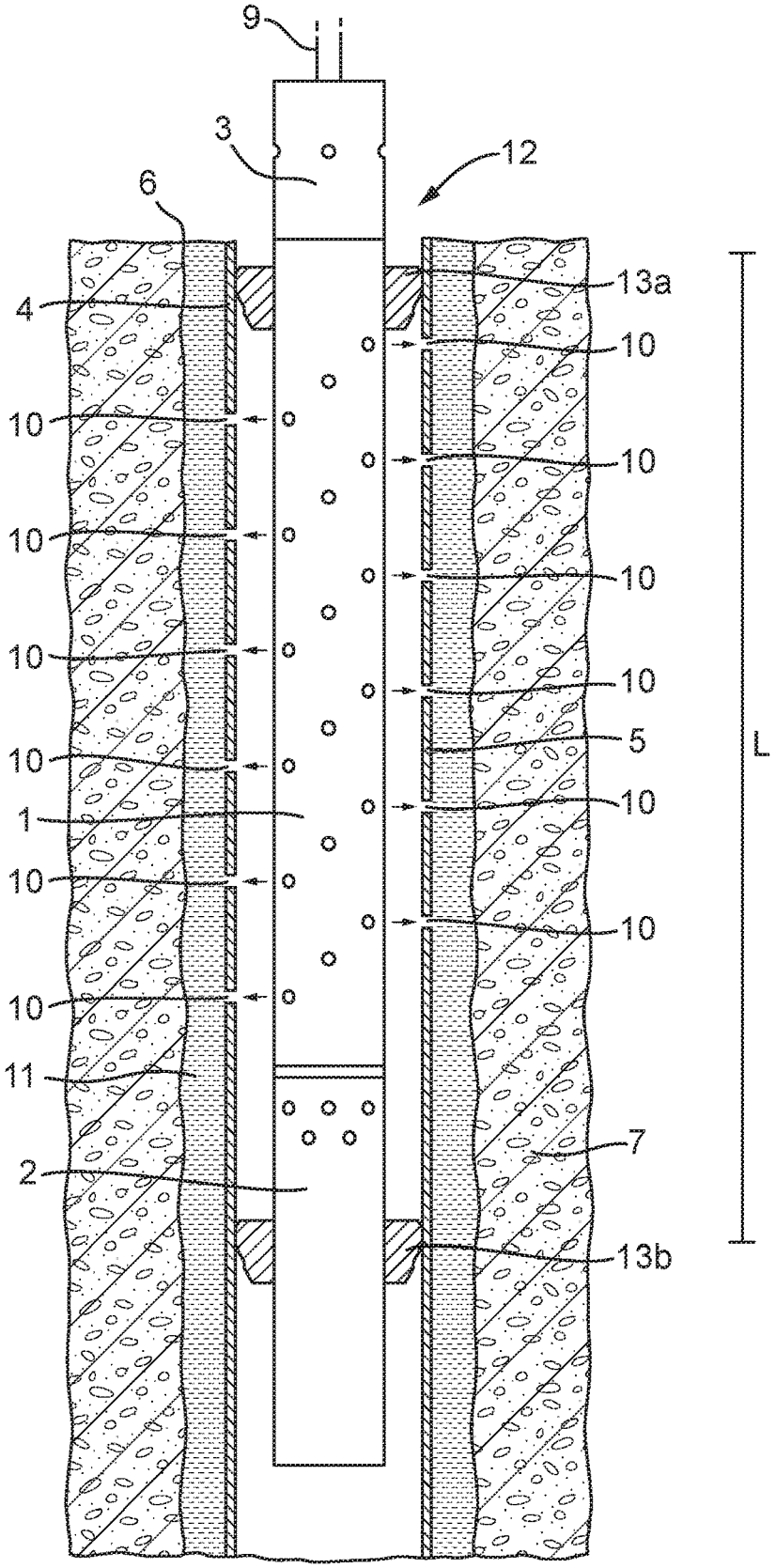
FIGS. 1-5 illustrate parts of a well section during various steps in a method according an embodiment.

Referring to FIG. 1, according to one embodiment, there is provided a method for plugging a subterranean well 6, for example a petroleum well. The well 6 is formed in a subterranean formation 7. A casing 4 is fixed in the well 6, forming an annulus 11 between the casing 4 and the wellbore walls. When the well 6 has reached the end of its useful life, or needs to be abandoned for other reasons, it is usually desired to provide a permanent plugging and sealing of the well. This may be done by placing a cement plug in the wellbore. It is usually necessary to ensure that the cement plug seals the entire cross-section of the well, i.e. also in the annulus 11 between the casing 4 and the wellbore walls. The annulus may comprise cement which was used when completing the well to hold the casing in place, it may comprise reservoir fluids, such as oil, drilling fluids, or it may comprise a combination of these. Before providing a plugging material in the annulus 11, it is necessary to ensure that no other fluids, materials or debris are present in the annulus which could reduce the performance or characteristics of the plugging material.

Figure 2:
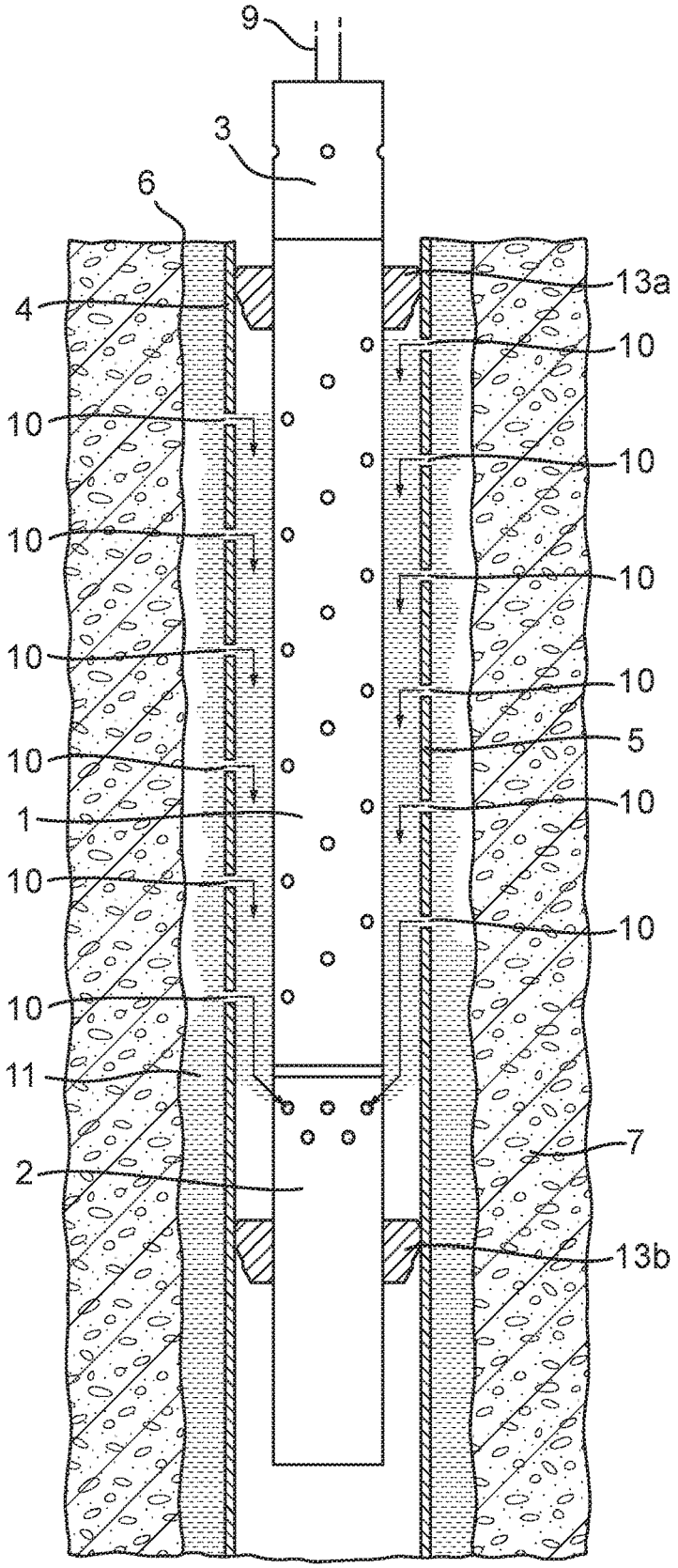
Figure 3:
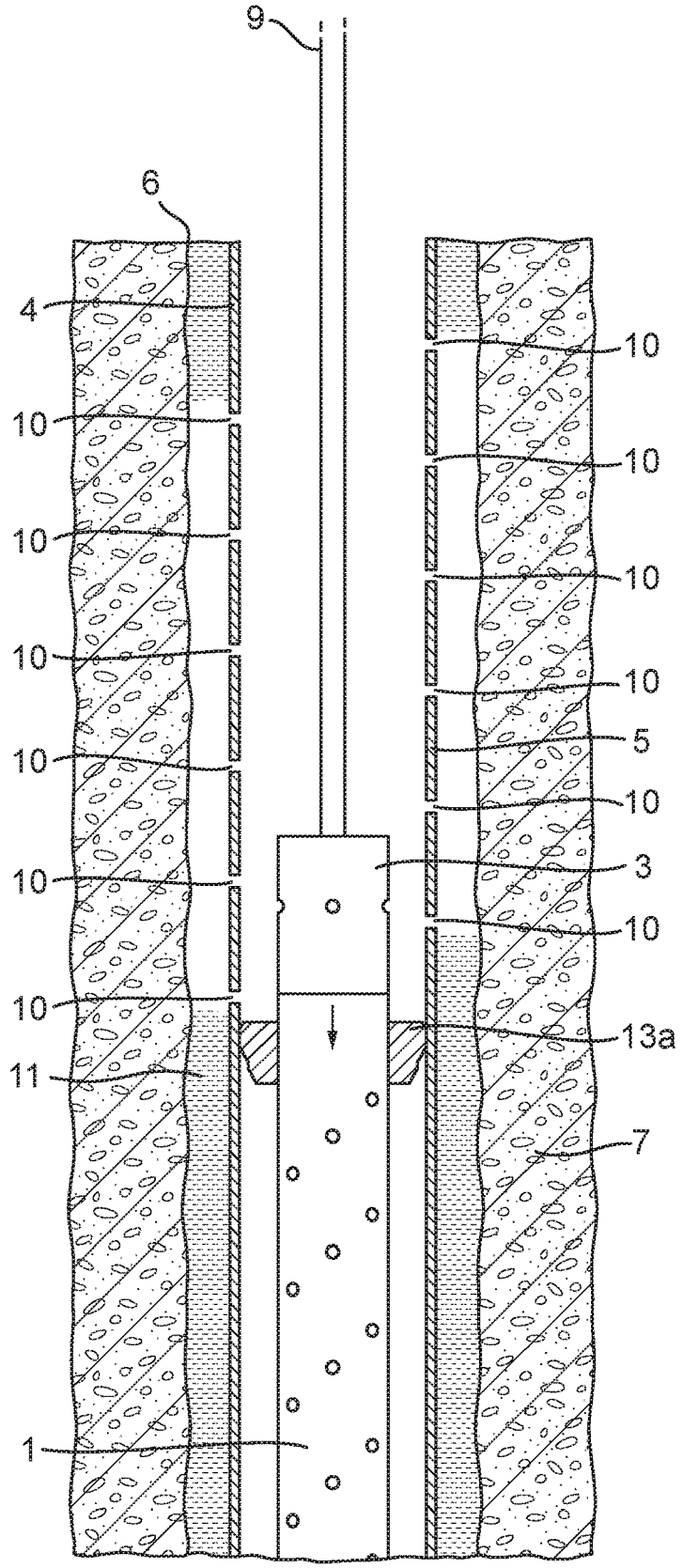
Figure 4:
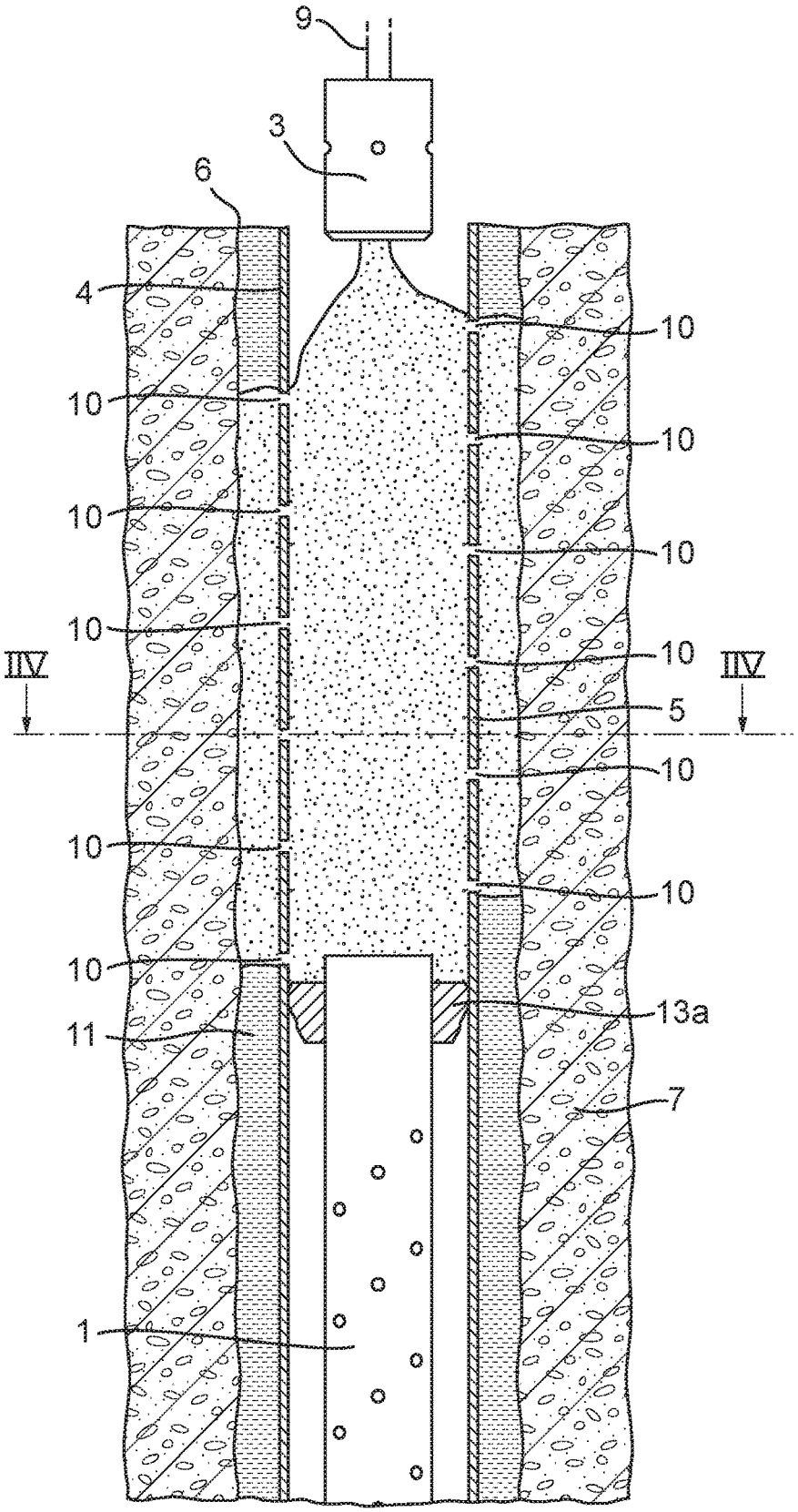

According to one embodiment, illustrated in FIGS. 1-3, this may be achieved by providing a tool assembly 12 having a perforating tool 1, a surge tool 2, and a cementing tool 3. The tool assembly 12 is carried by a section of tubing 9, whereby it can be lowered down into the well 6. The tool assembly 12 is run into the subterranean well 6 inside the casing 4 and positioned in a well section L to be plugged. Illustrated in FIG. 1, the perforating tool is then operated to create a plurality of holes (perforations) 10 in a part 5 of the casing 4 which is located in the well section L to be plugged. Illustrated in FIG. 2, the surge tool 2 is then operated to lower the pressure inside the part 5 of the casing 4 located in the well section L, whereby a flow of well fluid (i.e. any fluid present in the annulus 11) is generated, the well fluid flowing from the annulus 11 and into the casing 4 through the holes 10. Illustrated in FIGS. 3 and 4, the perforating tool 1 (and the surge tool 2) may then be moved downwards and hung off in the well below the holes 10 via seal element (packer) 13*a*, and then released from the cementing tool 3. As shown in FIG. 4, cement may then be pumped via the tubing string 9 into the well section L, i.e. into the part 5 of the casing 4 located in the well section L, which has been perforated. The cement will fill the casing 4 and flow into a part of the annulus 11 located in the well section L.

It has been discovered by the inventors that in certain cases the cleaning provided by flowing well fluid out of the annulus 11 by lowering the pressure in the part 5 of the casing 4 located in the well section L is sufficient for cleaning the annulus space in order to set a satisfactory cement plug. The effects of the perforation done by the perforating tool may break out and release sufficient fixed material in the annulus 11, and creates sufficient turbulence in the fluids present in the annulus 11, such that a subsequent flowing of those fluids out of the annulus provides a sufficient cleaning effect, e.g. removing fluids and debris from the annulus 11. Thereby the need to circulate washing fluid through (or into and out of) the annulus 11 is eliminated, and it is possible to proceed to pump a spacer fluid into the well section L and set the cement plug after having operated the surge tool 2.

Figure 5:
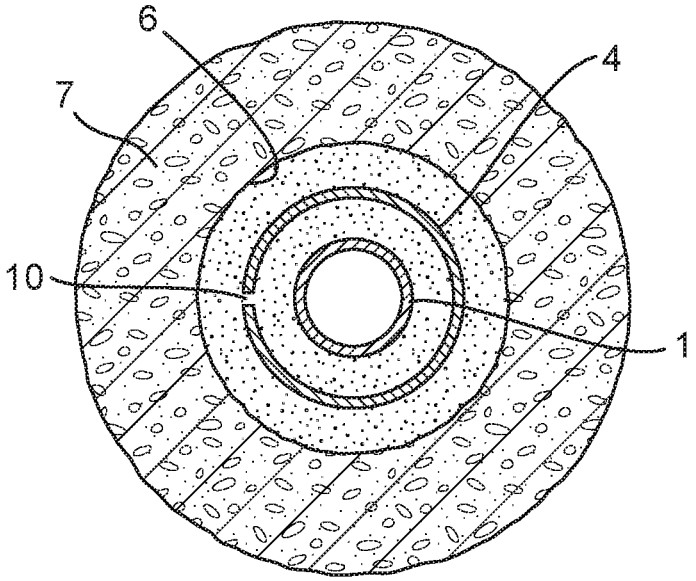

A cross-section IIV (see FIG. 4) of the cement plug after it has been set is illustrated in FIG. 5.

The surge tool 2 may operate as a pump to remove fluid from the well section L, thereby lowering the pressure in the part 5 of the casing 4 located in the well section L.

Figure 6:
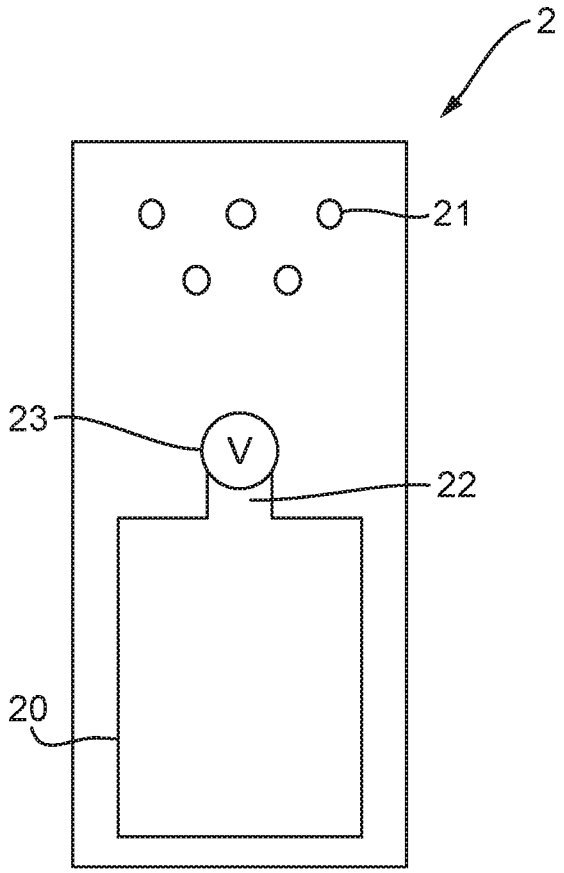
FIG. 6 illustrates a surge tool according to an embodiment.

The surge tool 2 may comprise a fluid chamber 20, illustrated schematically in FIG. 6, and operating the surge tool may comprise flowing fluid into the fluid chamber 20 and thereby away from the part 5 of the casing 4 located in the well section L. The fluid chamber 20 may be filled with gaseous fluid prior to running the surge tool 2 into the well. The fluid chamber 20 may be provided with an internal pressure being lower than the well pressure in the well section L to be plugged prior to running the surge tool 2 into the well. Thereby, liquids or other fluids present in the well section L may flow into the fluid chamber 20 when the surge tool 2 is operated. By providing a sufficiently low pressure in the fluid chamber 20, for example approximately atmospheric pressure, a rapid flow of fluid into the fluid chamber, when operated, may be achieved, thereby enhancing the washing effect of the fluids flowing from the annulus 11 and into the casing 4.

The fluid chamber 20 may be provided with an opening 22 having a flow barrier element 23. The flow barrier element 23 may be a valve such that flow of fluid into the fluid chamber can be started by opening the valve. Alternatively, the flow barrier element may be a breakable fluid restriction, and flow of fluid into the fluid chamber may be started by breaking the fluid restriction. Such breaking can, for example, be activated by pyrotechnics, gun system detonation or pressure or a surface signal to the tool.

As illustrated in FIG. 1-3, running the perforating tool 1 and the surge tool 2 can be carried out in a single trip into the well. This reduces the time required for plugging operations. Alternatively, running the perforating tool 1 and running the surge tool 2 may be performed in separate trips into the well. This may, for example, allow the perforating tool to be run in a wireline operation.

The perforating tool 1 and/or the surge tool 2 may be dropped in the well after use. Alternatively, the perforating tool 1 and/or the surge tool 2 may be hung off in the well after use. FIG. 4 illustrates the perforating tool 1 and the surge tool 2 being hung off in the casing 4 in or just below the well section (L) after use and prior to cementing. The surge tool 2 is provided with a seal element 13 with which the surge tool 2 and the perforating tool 1 are held in place in the casing 4. The surge tool 2 and the perforating tool 1 thereby provide a support for the cementing operation, i.e. a lower support for the cement plug until it solidifies. The surge tool 2 and perforating tool 1 may be hung off such that they are positioned partly in the well section L, as shown in FIG. 4, or hung off farther down, e.g. below the holes 10 or below the well section L entirely. In such a case, the seal element 13 may be provided on the upper part of the perforating tool 1.

Alternatively, if dropping the perforating tool 1 and the surge tool 2, the cementing tool 3 may be provided with a seal element which is fixed in the casing 4 below the perforations 10 prior to cementing, in order to support the cement plug, or a balanced cement plug can be set without a base.

The cement is then pumped into the well section L in a fluidized state via the tubing string 9. The cement is thereby pumped into the casing 4 and flows through the holes 10, distributes within the casing 4 and the annulus 11 and solidifies/hardens, so as to form a sealing plug across the full cross-section of the well 6.

Figure 7:
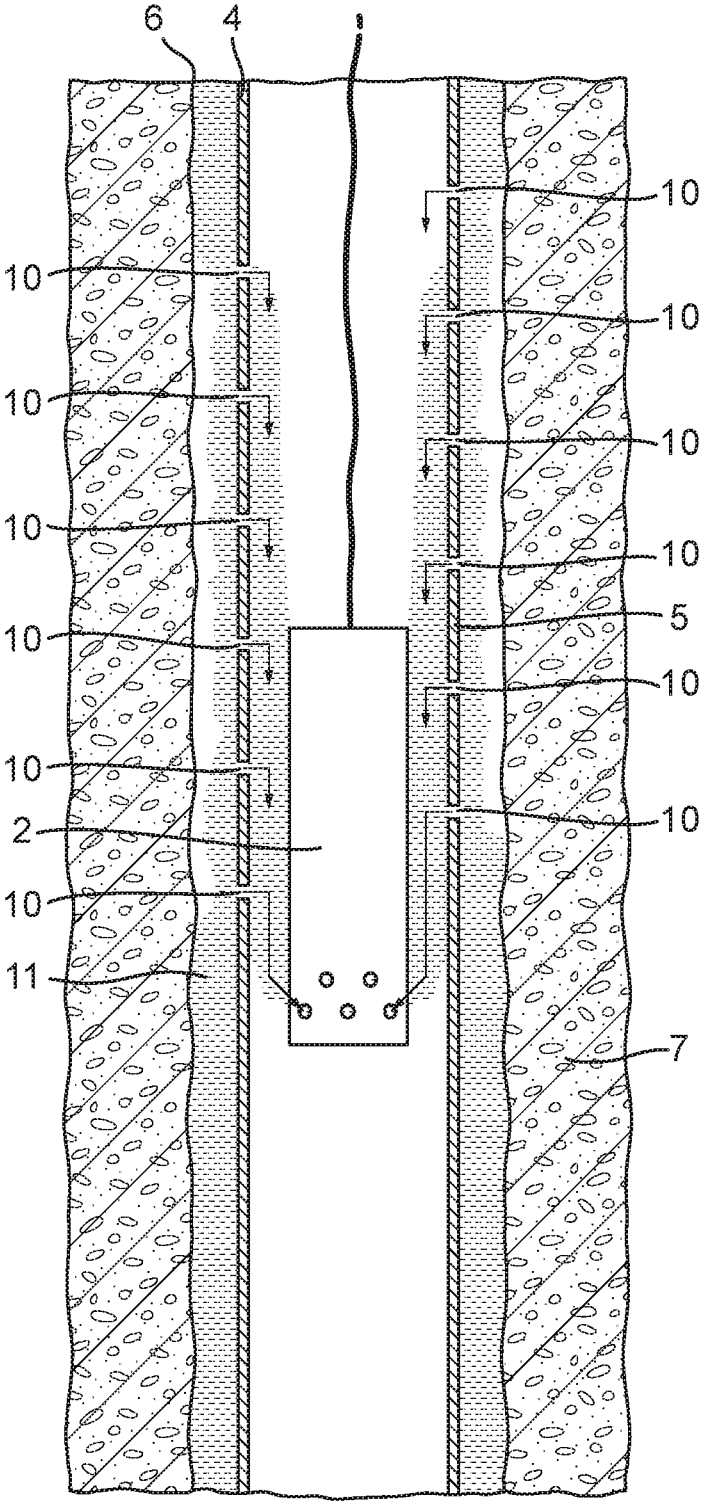
FIG. 7 illustrates a well section during a method according an embodiment.
Figure 8:
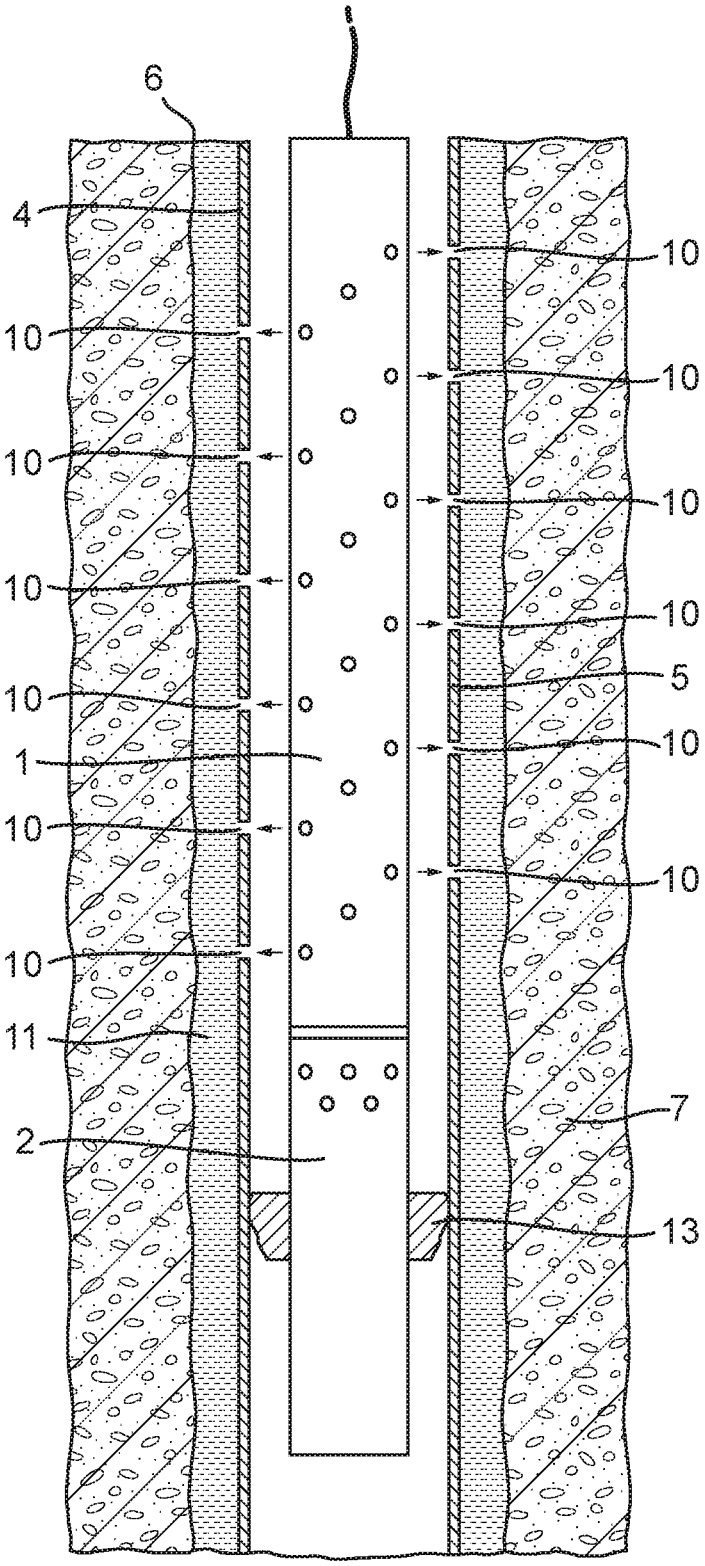
FIG. 8 illustrates a well section during a method according an embodiment.

Running the perforating tool 1 and/or running the suction tool 2 may be carried out in a wireline operation, whereby a wireline carries the suction tool 2 and/or the perforating tool 1 in separate trips or in the same trip into the well 6. Running the suction tool 2 alone by wireline into the well is illustrated in FIG. 7, whereas running the suction tool 2 and the perforating tool 1 together by wireline is illustrated in FIG. 8. Alternatively, running the perforating tool 1 and/or running the suction tool 2 may be carried out in a tubing operation, whereby a tubing string carries the suction tool 2 and/or the perforating tool 1 in separate trips or in the same trip into the well 6.

More than one set of perforating tools 1 and suction tools 2 may be run in the same operation, in order to set cement plugs at different depths of the well 6.

The invention is not limited to the embodiments described herein; reference should be had to the appended claims.

What is claimed is:

1. A method for plugging a subterranean well, comprising running a perforating tool into the subterranean well and positioning the perforating tool in a well section to be plugged, operating the perforating tool to create a plurality of holes in a part of a casing located in the well section, running a surge tool into the well, operating the surge tool to lower the pressure inside the part of the casing located in the well section and flowing a well fluid from an annulus between the casing and a well formation through the holes, and pumping a fluidized plugging material into the well section via a tubing string, further comprising causing the fluidized plugging material to harden such as to create a plug which extends across a cross section of the well;

wherein pumping a fluidized plugging material into the well section (L) comprises at least one of:

pumping the fluidized plugging material into the well section via a cementing tool connected to the tubing string; or flowing the fluidized plugging material into the part of the casing located in the well section and flowing the fluidized plugging material from the casing located in the well section and into the annulus between the casing and a well formation through the holes.

2. A method according to claim 1, wherein operating the surge tool includes removing fluid from the part via the surge tool.

3. A method according to claim 1, wherein the surge tool comprises a fluid chamber and operating the surge tool comprises flowing fluid into the fluid chamber.

4. A method according to claim 3, further comprising providing the fluid chamber gaseous fluid prior to running the surge tool into the well.

5. A method according to claim 3, further comprising providing the fluid chamber with an internal pressure being lower than a well pressure in the well section to be plugged prior to running the surge tool into the well.

6. A method according to claim 3, wherein the fluid chamber comprises an opening having a flow barrier element, and where the flow barrier element is a valve and flowing fluid into the fluid chamber includes opening the valve, or the flow barrier element is a breakable fluid restriction and flowing fluid into the fluid chamber includes breaking the fluid restriction.

7. A method according to any preceding claim, wherein running the perforating tool and running the surge tool are performed in a single trip into the well.

8. A method according to claim 1, wherein running the perforating tool and running the surge tool are performed in separate trips into the well.

9. A method according to claim 1, further comprising:

dropping the perforating tool in the well subsequent to operating the perforating tool, hanging off the perforating tool in the well subsequent to operating the perforating tool, dropping the surge tool in the well subsequent to operating the surge tool, or hanging off the surge tool in the well subsequent to operating the surge tool.

10. A method according to claim 9, wherein hanging off the perforating tool in the well subsequent to operating the perforating tool includes hanging off the perforating tool in or below the well section and in a sealing relationship with the casing, or hanging off the surge tool in the well subsequent to operating the surge tool includes hanging off the surge tool in or below the well section and in a sealing relationship with the casing.

11. A method according to claim 1, further comprising causing the fluidized plugging material to harden such as to create a plug which extends across a cross section of the well.

12. A method according to claim 1, wherein running the perforating tool or the running surge is done on a wireline lowered into the well.

13. A method according to claim 1, wherein running the perforating tool or running the surge tool is done on a tubing string lowered into the well.

* * * * *